US006439371B1

(12) United States Patent
Baulier

(10) Patent No.: US 6,439,371 B1
(45) Date of Patent: Aug. 27, 2002

(54) WORKPIECE LOADER/UNLOADER SYSTEM

(75) Inventor: Dominique Baulier, Windsor (CA)

(73) Assignee: Valiant Corporation (CA)

( * ) Notice: Subject to any disclaimer, the term of this patent is extended or adjusted under 35 U.S.C. 154(b) by 0 days.

(21) Appl. No.: 09/808,244

(22) Filed: Mar. 14, 2001

(51) Int. Cl.[7] ..... B65G 37/00
(52) U.S. Cl. ..... 198/468.2; 901/6; 901/7
(58) Field of Search ..... 414/749.1; 198/468.2; 901/6, 7

(56) References Cited

U.S. PATENT DOCUMENTS 5,046,916 A * 9/1991 Leif ..... 901/6 X
5,215,181 A * 6/1993 Blatt ..... 198/468.2

* cited by examiner

*Primary Examiner*—Donald W. Underwood

(74) *Attorney, Agent, or Firm*—Gifford, Krass, Groh, Sprinkle, Anderson & Citkowski, P.C.

(57) ABSTRACT

A workpiece loader/unloader system for an industrial machine, such as a hemmer, is disclosed. The system includes a single pocket shuttle movable between an extended position in which the shuttle overlies a work station on the industrial machine, and a retracted position in which the shuttle is laterally spaced from the work station. A gripper on the shuttle selectively engages and supports the workpiece after the workpiece has been machined at the work station. A loader manipulator is movable between a preload position in which the loader supports an unmachined workpiece at a position laterally spaced from the work station, and a load position in which the loader manipulator overlies the work station. An actuator moves the loader manipulator between the preload and load position. Furthermore, the loader manipulator mechanically engages the shuttle and simultaneously moves the shuttle from its extended position and to its retracted position as the loader manipulator moves from its preload and to its load position. A passive system, such as a spring, returns the shuttle from its retracted and to its extended position.

11 Claims, 5 Drawing Sheets

WORKPIECE LOADER/UNLOADER SYSTEM

BACKGROUND OF THE INVENTION

I. Field of the Invention

The present invention relates generally to a loader/unloader system for use with an industrial machine, such as a hemming machine.

II. Description of the Prior Art

Many industrial machines, such as hemming machines, include a work station adapted to receive an unmachined part whereupon the machine performs its particular machining operation. Following the machining operation, the now machined workpiece is removed from the work station and replaced by an unmachined workpiece whereupon the entire operation is repeated.

Most industrial applications utilize both a loader robot for moving unmachined parts from inventory and into the work station on the machine. Similarly, an unloader robot is then utilized to remove the finished workpieces following the machining operation from the work station. Typically, conventional conveyor systems supply the loader robot with unmachined workpieces while, similarly, conventional conveying systems remove the machined workpieces from the unloader robot.

It is, of course, imperative that the loader robot avoid collision, or any possible collision, with the unloader robot at all times. Any such collision between the loader and unloader robots, or the parts which they transport, would result in damage not only to the workpieces transported by the loader and/or unloader robots, but also potentially damage the robots themselves.

Consequently, it has been the previously known practice to program both the loader and unloader robots to avoid collision with each other by sequentially interlocking the motion of each robot to avoid interference and conflicts. This robot sequencing in the time results in a time delay of several seconds sufficient to terminate operation of either the loader or unloader operation in the event of a system jam or other malfunction and still avoid a collision between the loader and unloader robots.

The previously known practice of utilizing loader and unloader robots for a machining operation, such as a hemming operation, suffers from two primary disadvantages. One disadvantage is that the loader and unloader robots are expensive both in acquisition and operating costs. Furthermore, the necessity of having both a separate loader robot and unloader robot for each machine significantly increases the overall cost of performing the machining operation.

A still further disadvantage of these previously known loader and unloader robotic systems is that the part exchange operation necessarily consumes several seconds more than an unflexible transfer system, typically about five seconds, after each machining operation to ensure that the loader and unloader robots do not collide together. This, however, necessarily lengthens the cycle time for the machining operation by several seconds. Since each machining operation may itself only consume twelve to sixteen or thirty seconds, the addition of five seconds to each machining cycle effectively increases the cycle time up to 30%.

SUMMARY OF THE PRESENT INVENTION

The present invention provides a loader/unloader system for a machine which overcomes all of the above-mentioned disadvantages of the previously known systems.

In brief, the present invention provides a workpiece loader/unloader system for an industrial machine, such as a hemming machine, in which the industrial machine has a work station adapted to receive unmachined workpieces. Once the unmachined workpiece is positioned at the work station, the industrial machine undergoes a machining operation thus forming a machined workpiece.

The loader/unloader system comprises a shuttle which is movable between an extended position and a retracted position. In its extended position, the shuttle overlies the work station. Conversely, when the shuttle is in its retracted position, the shuttle is laterally spaced from the work station.

At least one gripper is mounted to the shuttle and selectively engages and supports the workpiece after the workpiece has been machined at the work station. Preferably, the gripper includes at least two fingers which, when in their engaged position, extend underneath the workpiece following a machining operation at the work station.

A loader manipulator is movable between a preload position and a load position. In its preload position, the loader manipulator supports an unmachined workpiece at a position laterally spaced from the work station. Conversely, at its load position, the loader manipulator overlies the work station and selectively positions the unmachined workpiece into the work station of the machine.

Unlike the previously known loader/unloader systems, however, the loader manipulator includes a pin which mechanically engages the slot in the shuttle when the loader/manipulator is positioned at a preload position, i.e. laterally spaced from the work station. Then, as the loader manipulator is moved to its loader position in which the loader manipulator with its unmachined workpiece overlies the work station, the loader manipulator simultaneously mechanically pushes the shuttle laterally from its extended position and to its retracted position.

With the shuttle at its retracted position, a retaining pin engages the shuttle and holds the shuttle at its retracted position. The finished workpiece which is carried by the shuttle is then removed from the shuttle in any conventional fashion. During the removal of the workpiece from the shuttle, however, the loader manipulator disengages from the shuttle and is moved to acquire a new unmachined workpiece.

After the machined workpiece is removed from the shuttle, the retaining pin is retracted and preferably a passive means such as a spring, or an active means such as an air cylinder, returns the shuttle to its extended position so that the shuttle overlies the machine work station. The grippers on the shuttle are then opened, the completed or machined workpiece positioned within the shuttle, and the grippers are then moved to their engaged position. At that time, the loader manipulator with its new unmachined workpiece mechanically engages the shuttle whereupon the above process is repeated.

Unlike the previously known loader/unloader systems, since the loader manipulator is utilized not only to load unmachined workpieces into the work station but also to mechanically move the shuttle with its completed or machined workpiece laterally away from the workstation, the previously known inclusion of several seconds to avoid collision between the loader robot and unloader robot is completely avoided. Indeed, mechanical contact between the loader manipulator and the shuttle assembly occurs during each machining cycle.

A still further advantage of the present invention is that, since the loader manipulator is used not only to load unmachined parts into the work station but also to mechanically push the shuttle with its completed workpiece away from the work station, only a single robotic manipulator is required to perform both the load and unload operations. This, in turn, significantly reduces the overall cost of the loader/unloader system.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF A PREFERRED

Embodiment of the Present Invention

Figure 1:
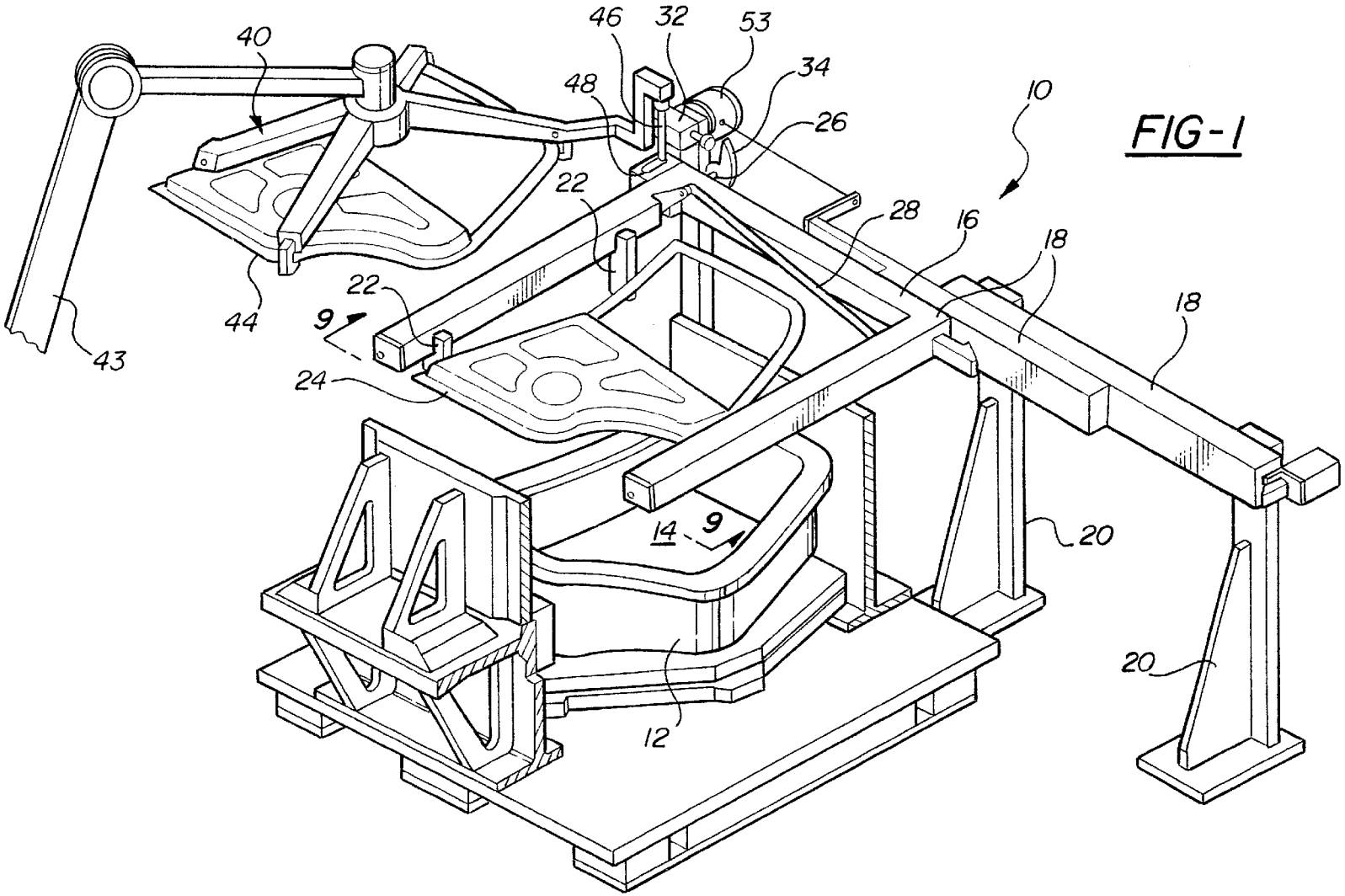
FIG. 1 is an elevational view illustrating a preferred embodiment of the present invention.

With reference first to FIG. 1, a preferred embodiment of the loader/unloader system 10 of the present invention is there shown for use with an industrial machine 12, such as a hemming machine. The machine 12, in the conventional fashion, includes a work station 14. Unmachined workpieces are positioned at the work station 14, machined, and then returned from the work station 14 as finished machine workpieces.

Figure 2:
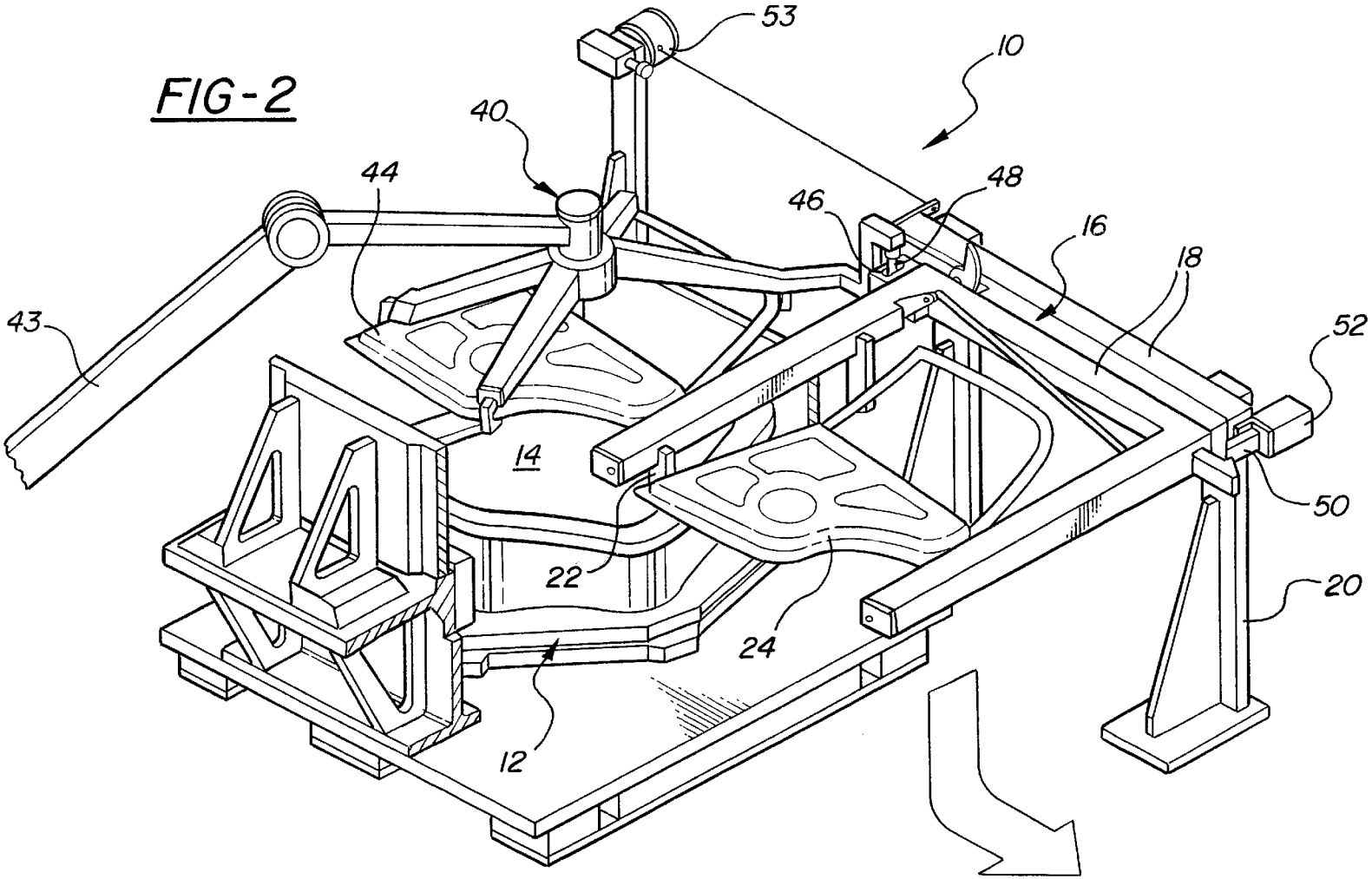
FIG. 2 is a view similar to FIG. 1, but illustrating the preferred embodiment in a different machining position.

Referring to FIGS. 1 and 2, the system 10 of the present invention comprises a shuttle 16 which is laterally movable between an extended position, illustrated in FIG. 1, and a retracted position, illustrated in FIG. 2. Any conventional means may be employed to allow the shuttle to move between its extended position and retracted position. However, in the preferred embodiment of the invention, the shuttle 16 is mounted by telescopic slides 18 to stationary frame members 20.

The shuttle 16 is generally U-shaped and, when in its extended position, overlies the work station 14. Furthermore, the shuttle 16 includes at least one, and preferably several grippers 22 which are adapted to extend underneath and support a finished workpiece 24 following a machining operation by the machine 12 at the work station 14.

Figure 9:
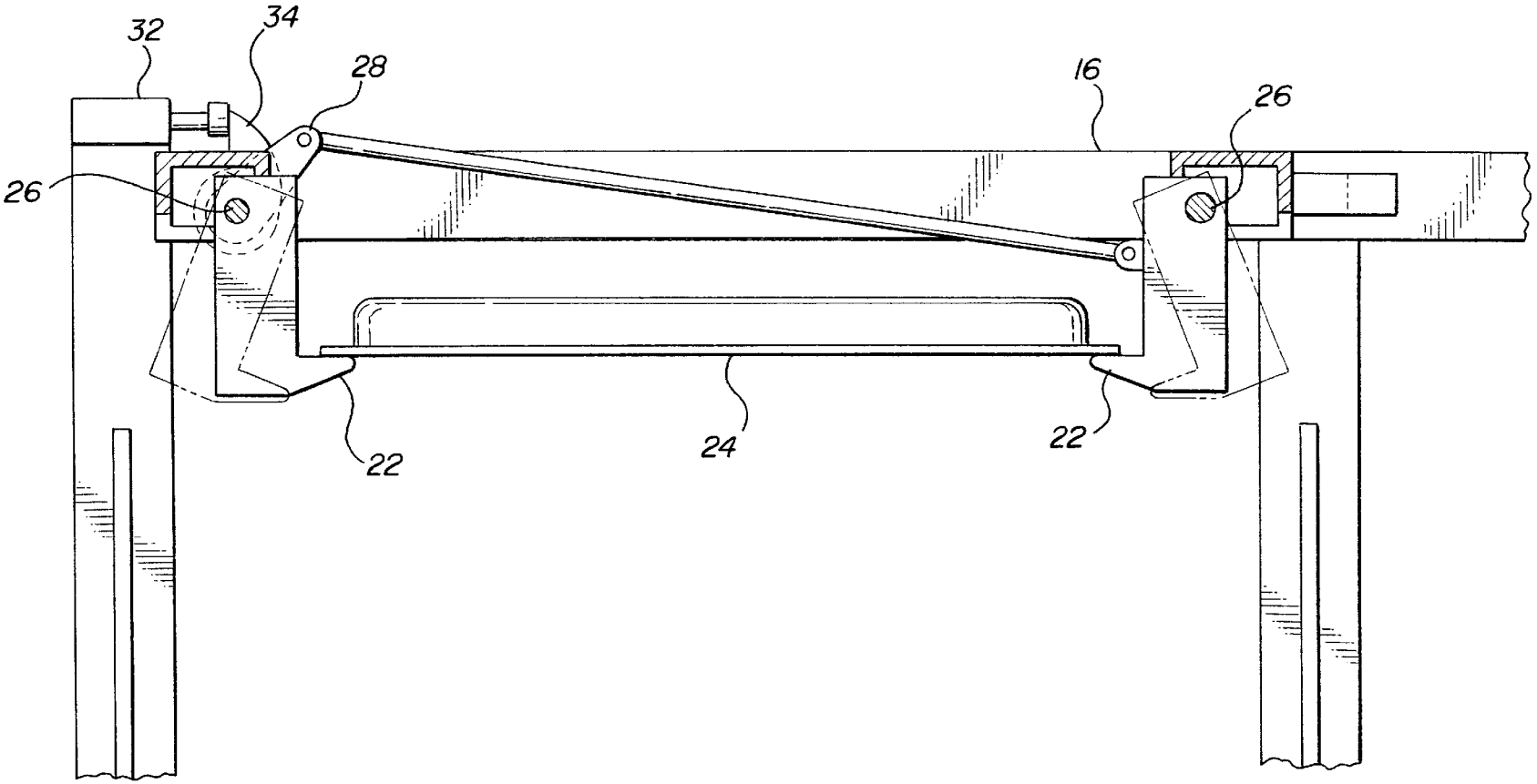
FIG. 9 is a fragmentary view illustrating one portion of the present invention.

Referring now particularly to FIGS. 1 and 9, preferably the grippers 22 include a plurality of fingers which are secured to an elongated shaft 26. The elongated shaft 26 is rotatably mounted to one side of the shuttle 16 while a similar shaft with grippers is mounted to the opposite side of the shuttle 16.

Consequently, as shown in FIG. 9, rotation of the shaft 26 operatively moves the grippers 22 between their engage position, illustrated in solid line, and their release position, illustrated in phantom line. A crank arm and actuating lever 28 also extend between the shaft 26 at one side of the shuttle 16 and the corresponding shaft at the other side of the shuttle 16 so that the grippers 22 all move in unison with each other.

With the shuttle 16 in its extended position and thus overlying the work station 14, the grippers 22 are first moved to their release position in order to enable the finished workpiece 24 to be upwardly ejected from the work station 14 and into the interior of the shuttle 16. Any conventional means, such as a stationary air cylinder 32 (FIGS. 1 and 9) and lever 34 connected to the shaft 26, may be used to move the grippers 22 to their release position.

With the finished workpiece 24 positioned within the shuttle 16, the grippers 22 are then moved to their engage position so that the grippers 22 are positioned beneath and support the finished workpiece 24. Preferably, the grippers 22 are resiliently biased by any conventional spring towards their engage position so that merely actuating the actuator 32 to retract it from the lever 34 is sufficient to move the grippers 22 to their engage position.

With reference now to FIGS. 1 and 2, a loader manipulator 40, which is preferably moved by a robot 43, selectively engages and supports an unmachined workpiece 44. The loader manipulator 40, furthermore, includes a downwardly extended elongated pin 46 along the side of the loader manipulator 40 closest to the shuttle 16.

The elongated pin 46 is received within a slot 48 formed in the shuttle. Thus, as the pin 46 is positioned within the slot 48, lateral movement of the loader manipulator 40 by the robot 43 simultaneously laterally moves the shuttle 16 from its extended position (FIG. 1) and towards its retracted position (FIG. 2) in unison with the loader manipulator 40, at least along the axis of movement of the shuttle 16.

The loader manipulator 40 is movable between a preload position, illustrated in FIG. 1, and a load position, illustrated in FIG. 2. In its preload position, the loader manipulator 40 with its supported unmachined workpiece 44 is laterally spaced from the machine work station 14. Conversely, as the loader manipulator 40 is moved to its load position, the loader manipulator 40 overlies the work station 14 and simultaneously moves the shuttle 16 to its retracted position.

With the loader manipulator 14 at its load position and the shuttle 16 at its retracted position, a retainer pin 50 (FIG. 2) and actuator 52 engage the shuttle 16 and retain the shuttle 16 at its retracted position. Simultaneously, the loader manipulator 40 lowers the unfinished part 44 into the work station 14.

Thereafter, any conventional unloading robot (not shown) is used to remove the finished workpiece from the shuttle 16. Typically, the unloading robot will convey the finished workpiece to an appropriate and conventional conveyor system. Simultaneously, however, the loader manipulator 40 disengages by moving vertically upwardly from the shuttle 16 so that the pin 46 disengages from the shuttle slot 48. The loader manipulator 40 then moves to a position to obtain a new unmachined workpiece, typically from a conventional conveyor system, and then moves to its preload position.

After the robot has removed the finished part from the shuttle 16, the actuator 52 disengages the pin 50 from the shuttle assembly 16. Any conventional means is then used to return the shuttle assembly 16 to its extended position whereupon the above process is repeated. Preferably, however, a passive means, such as air spring 53 (FIG. 2), is utilized to return the shuttle 16 from its retracted position and to its extended position.

Although the operation of the loader/unloader system should by now be clear, it will be summarized in the interest of completeness. As best shown in FIG. 1, at the completion of a machining operation, the shuttle 16 is positioned so that the shuttle 16 overlies the work station. At this time, the grippers 22 are moved to their release position so that the machine workpiece can be moved up into the shuttle 16, and pass the gripper fingers 22. When this occurs, the stationary actuator 32 is deactivated thus allowing the gripper fingers 22 to return to their engage position in which the gripper fingers 22 support the machined workpiece from its lower surface.

Simultaneously as the shuttle 16 receives the finished workpiece, the loader manipulator 40 is moved into its preload position in which the pin 46 is positioned within the shuttle slot 48. At this time, the loader manipulator 40 is laterally spaced from, but mechanically engaged with, the shuttle 16.

Figure 4:
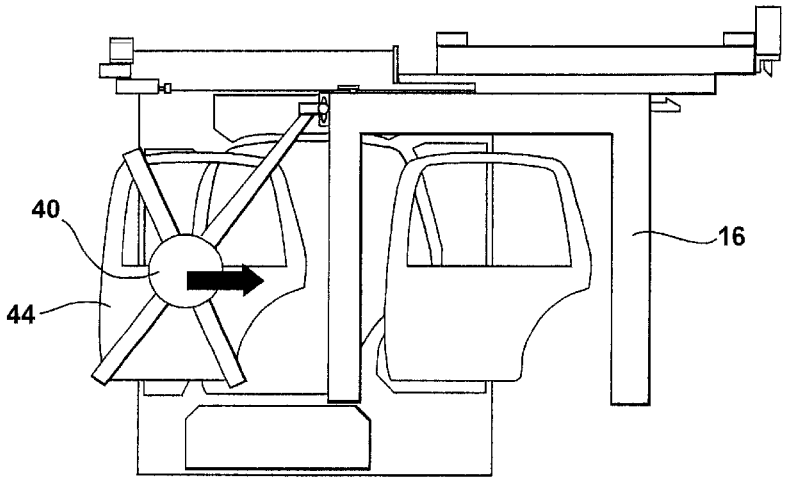
Figure 5:
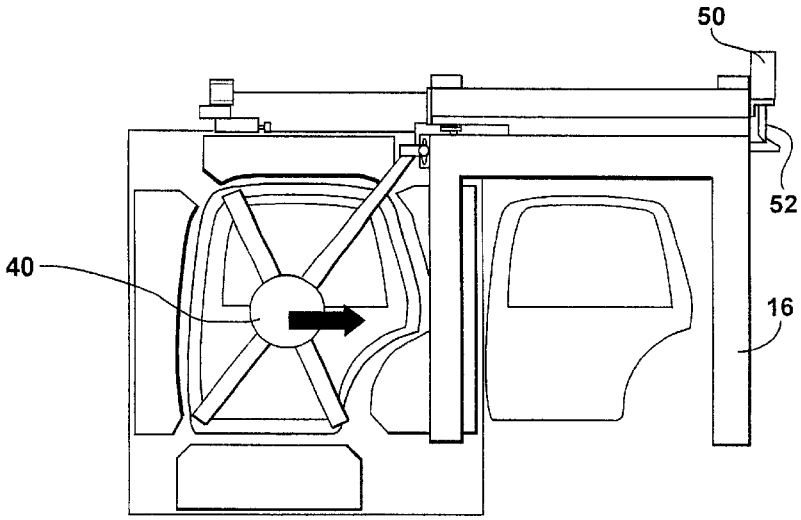

As best shown in FIGS. 4–5, the loader manipulator 40 is moved by the robot 43 from its preload position and to a position in which the loader manipulator overlies the work station 14 (FIG. 5). Simultaneously, the movement of the loader manipulator 40 from its preload and to its load position pushes or mechanically moves the shuttle assembly 16 from its extended position and to its retracted position. With the shuttle assembly in its retracted position (FIG. 5), the retaining pin 50 is actuated by the actuator 52 thus retaining the shuttle assembly 16 in its retracted position. Simultaneously, the loader manipulator 40 moves downwardly and deposits its unfinished workpiece 44 at the work station 14.

Figure 6:
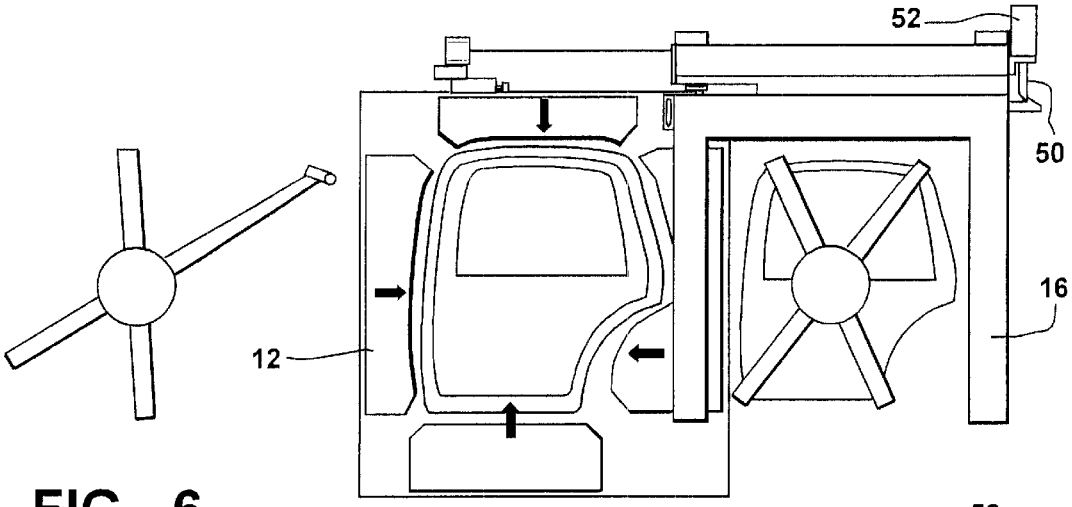

As best shown in FIG. 6, with the shuttle 16 retained at its retracted position by the retaining pin 50, the loader manipulator 40 moves upwardly so that it disengages from the shuttle 16 and then moves laterally away from the shuttle 16 and to a position where the loader manipulator obtains the next unmachined part. Simultaneously, at this time, a machining operation is being performed at the work station 14 by the machine 12. Simultaneously, any conventional means is used to remove the finished or machined workpiece from the shuttle 16.

Figure 7:
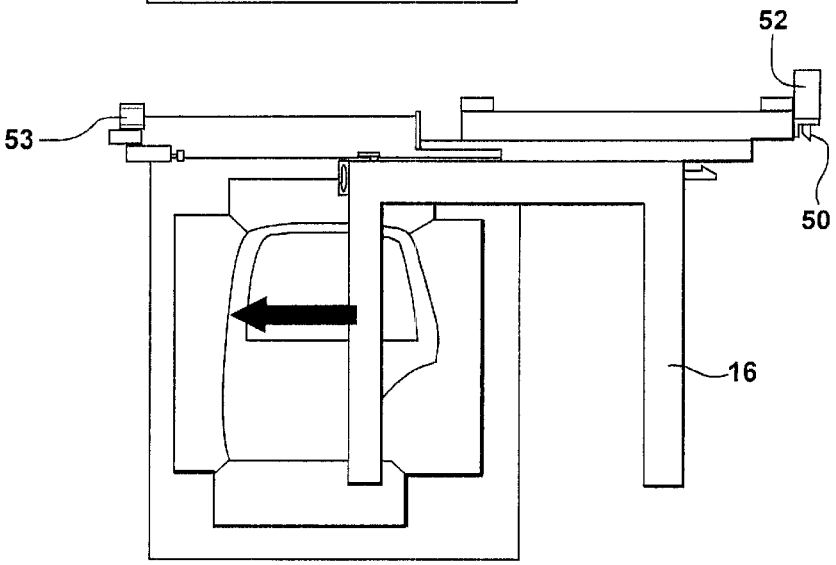

With reference now to FIG. 7, after the machined workpiece is removed from the shuttle 16 and while the machining operation continues at the work station 14, the retaining pin 52 is moved to its retracted position thus releasing the shuttle 16 to return from its retracted position and to its extended position by the air spring 53.

Figure 3:
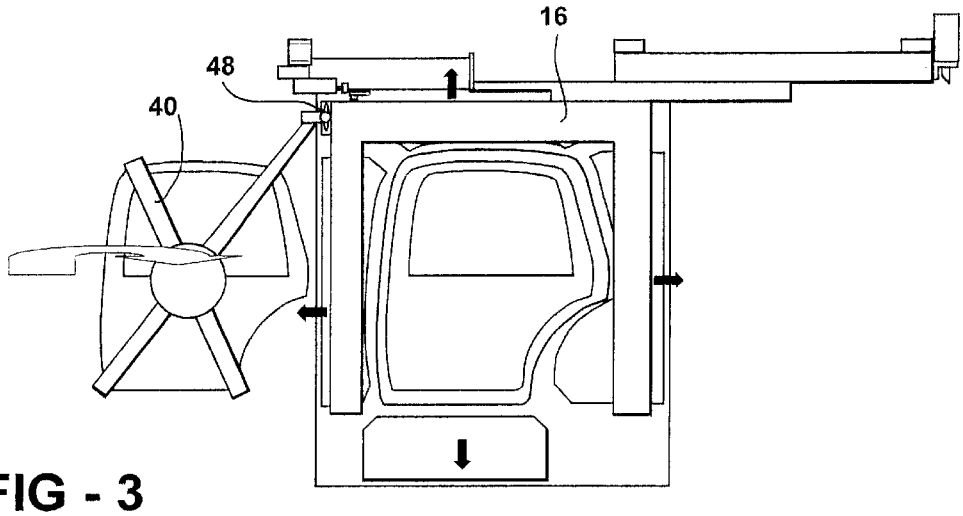
FIGS. 3–8 are top diagrammatic views illustrating the operation of the preferred embodiment of the invention.
Figure 8:
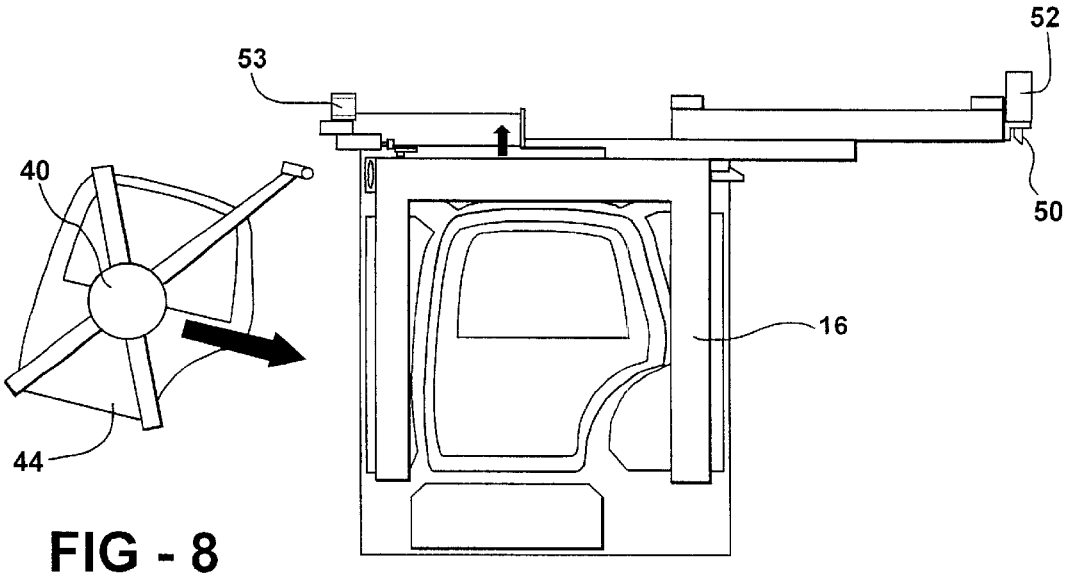

As best shown in FIG. 8, with the shuttle at its extended position and ready to receive the finished workpiece from the work station 14, the loader manipulator 40 is again moved towards its preload position (FIG. 3) in which the loader manipulator mechanically engages the shuttle 16 and the above process is repeated.

From the foregoing, it can be seen that the present invention provides a simple and yet highly effective system for a loader/unloader system for an industrial machine, such as a hemming machine. Having described my invention, however, many modifications thereto will become apparent to those skilled in the art to which it pertains without deviation from the spirit of the invention as defined by the scope of the appended claims.

I claim:

1. A workpiece loader/unloader system for an industrial machine, said industrial machine having a work station into which unmachined workpieces are sequentially loaded, machined and removed, said loader/unloader system comprising:

a shuttle movable between an extended position in which said shuttle overlies the work station and a retracted position in which said shuttle is laterally spaced from said work station, at least one gripper mounted to said shuttle which selectively engages and supports the workpiece after the workpiece has been machined at the work station, a loader manipulator movable between a preload position in which said loader manipulator supports an unmachined workpiece at a position laterally spaced from the work station and a load position in which said loader manipulator overlies the work station, an actuator which moves said loader manipulator between said preload and said load positions, wherein said loader manipulator mechanically engages said shuttle and simultaneously moves said shuttle from said extended position to said retracted position as said loader manipulator moves from said preload to said load position.

2. The invention as defined in claim 1 and comprising passive means for moving said shuttle assembly from said retracted to said extended position.

3. The invention as defined in claim 2 wherein said passive means comprises a spring.

4. The invention as defined in claim 2 and comprising means for selectively retaining said shuttle in said retracted position.

5. The invention as defined in claim 4 wherein the means for selectively retaining said shuttle is activated by a stationary actuator.

6. The invention as defined in claim 1 wherein said shuttle includes a receiving recess and wherein said loader manipulator comprises a pin which, when positioned in said receiving recess, mechanically locks said loader manipulator and said shuttle together so that said shuttle and said loader manipulator move in unison with each other along an axis of movement of said shuttle.

7. The invention as defined in claim 1 wherein said at least one gripper is positioned below and supports a lower surface of the machined workpiece and comprising an unloader manipulator which removes the machined part from said shuttle when said shuttle is in said retracted position.

8. The invention as defined in claim 7 wherein said at least one gripper can be retracted by a stationary actuator.

9. The invention as defined in claim 1 wherein such loader/unloader system allows one robot to achieve all handling.

10. The invention as defined in claim 3 whereas said spring comprises a mechanical spring.

11. The invention as defined in claim 3 wherein said spring comprises an air spring.

* * * * *